United States Patent [19]

Sorrells

[11] Patent Number: 5,035,684

[45] Date of Patent: Jul. 30, 1991

[54] PAD SANDER PAPER PUNCH ASSEMBLY AND METHOD

[75] Inventor: Anthony M. Sorrells, Easley, S.C.

[73] Assignee: Ryobi Motor Products Corp., Pickens, S.C.

[21] Appl. No.: 514,550

[22] Filed: Apr. 26, 1990

[51] Int. Cl.[5] ..... B31B 49/00

[52] U.S. Cl. ..... 493/342; 493/352; 493/373; 30/362; 30/366

[58] Field of Search ..... 493/342, 354, 356; 83/93; 30/368, 358, 359, 362, 366

[56] References Cited

U.S. PATENT DOCUMENTS

| | | | |
|---|---|---|---|
| 1,871,597 | 10/1929 | English | 30/358 |
| 3,073,199 | 1/1963 | Yerkes | 30/358 |
| 3,824,689 | 7/1974 | Hutchins | 30/368 |
| 3,854,206 | 12/1974 | Hutchins | 30/368 |
| 3,859,726 | 1/1975 | Mitsunari | 30/358 |
| 3,866,304 | 2/1975 | Hutchins | 29/445 |
| 3,906,633 | 9/1975 | Inoue | 30/358 |

*Primary Examiner*—Frederick R. Schmidt
*Assistant Examiner*—John Addison Marlott
*Attorney, Agent, or Firm*—David L. Davis

[57] ABSTRACT

A pad sander paper punch assembly includes a base member having three upstanding walls for locating thereon a standard size sheet of sandpaper. A plate member is then placed over the sheet of sandpaper, the plate member having locating tabs which cooperate with the upstanding walls on the base member. The plate member and the base member are both perforated in locations corresponding to suction holes on the platen of the pad sander and a punch is then utilized to pass through the plate and base member perforations to appropriately perforate the sandpaper sandwiched therebetween. The base member is further formed with recessed walls so that the sandpaper may be creased at its ends to go over the sander platen with the perforations therein properly aligned with the suction holes in the sander platen.

3 Claims, 3 Drawing Sheets

PAD SANDER PAPER PUNCH ASSEMBLY AND METHOD

BACKGROUND OF THE INVENTION

This invention relates to accessories for use with a pad sander and, more particularly, to a sandpaper punch and sizing assembly for providing from a standard size sheet of sandpaper an appropriately sized and perforated piece of sandpaper suitable for use with a pad sander having spaced suction holes in its platen.

Powered pad sanders are known which have air suction holes in their platens for removing abrasion-created debris from the work area. In order to accomplish this desireable result, the sandpaper which is affixed to and covers the underside of the platen must have corresponding air suction holes therein. The air suction holes in the sandpaper must, for obvious reasons, be aligned with the corresponding suction holes in the sander platen. It is therefore a primary object of this invention to provide an assembly for so perforating the sandpaper.

One arrangement for perforating the sandpaper is disclosed in U.S. Pat. No. 3,824,689. As disclosed in the '689 patent, the sandpaper is first affixed to the sander platen which is then brought into contact with a piercing tool which has a base plate and a plurality of spiked projections spaced to conform with the suction holes in the sander platen. A pair of flanges are formed on the base plate which are perpendicular to each other, allowing the sander platen to be properly located on the base plate for alignment of the spiked projections with the suction holes. This arrangement possesses a number of disadvantages. For example, if the sander is not properly aligned on the base plate, the spiked projections will not perforate the sandpaper in the proper locations and may also damage the platen. Also, the spiked projections present a safety hazard to the user. It is therefore another object of this invention to provide a perforating assembly which does not present a safety hazard and cannot cause damage to the sander platen.

Another known arrangement is an assembly including a base member, a plate and a punch. The base member and the plate are perforated in locations corresponding to the platen suction holes. The sandpaper is cut to size and placed on the base member. The plate is then placed over the sandpaper and the punch is passed through the aligned perforations of the plate and the base member to perforate the sandpaper held therebetween. This arrangement has the disadvantage that the sandpaper must be precut to size and also if the sandpaper is not properly placed on the base member, it will not properly fit on the sander platen.

Accordingly, it is an object of the present invention to provide an assembly and a method for cutting to size, perforating air suction holes in, and precreasing a sheet of abrasive material for use with a powered pad sander having spaced suction holes in its platen, which assembly and method do not suffer from the aforedescribed disadvantages.

SUMMARY OF THE INVENTION

The foregoing, and additional, objects are attained in accordance with the principles of this invention by providing an assembly including a base member, a plate member and a punch. The base member and the plate member have perforations in locations corresponding to the suction holes in the sander platen and the base member also includes means for accurately locating a standard size sheet of sandpaper thereon. The sandpaper is sandwiched between the base member and the plate member for tearing against an edge of the plate member so that it is sized for installation on the sander platen, the width of the plate member being the same as the width of the sander platen. The punch is then manipulated through the perforations of the plate member and the base member so that the sandpaper is perforated in appropriate locations.

In accordance with an aspect of this invention, the base member is further formed with recessed walls appropriately located to allow the sandpaper to be precreased for subsequent wrapping around the sander platen with accurate alignment of the sandpaper perforations with the sander platen suction holes.

BRIEF DESCRIPTION OF THE DRAWINGS

The foregoing will be more readily apparent upon reading the following description in conjunction with the drawings in which like elements in different figures have the same reference numeral and wherein.

DETAILED DESCRIPTION

Figure 1:
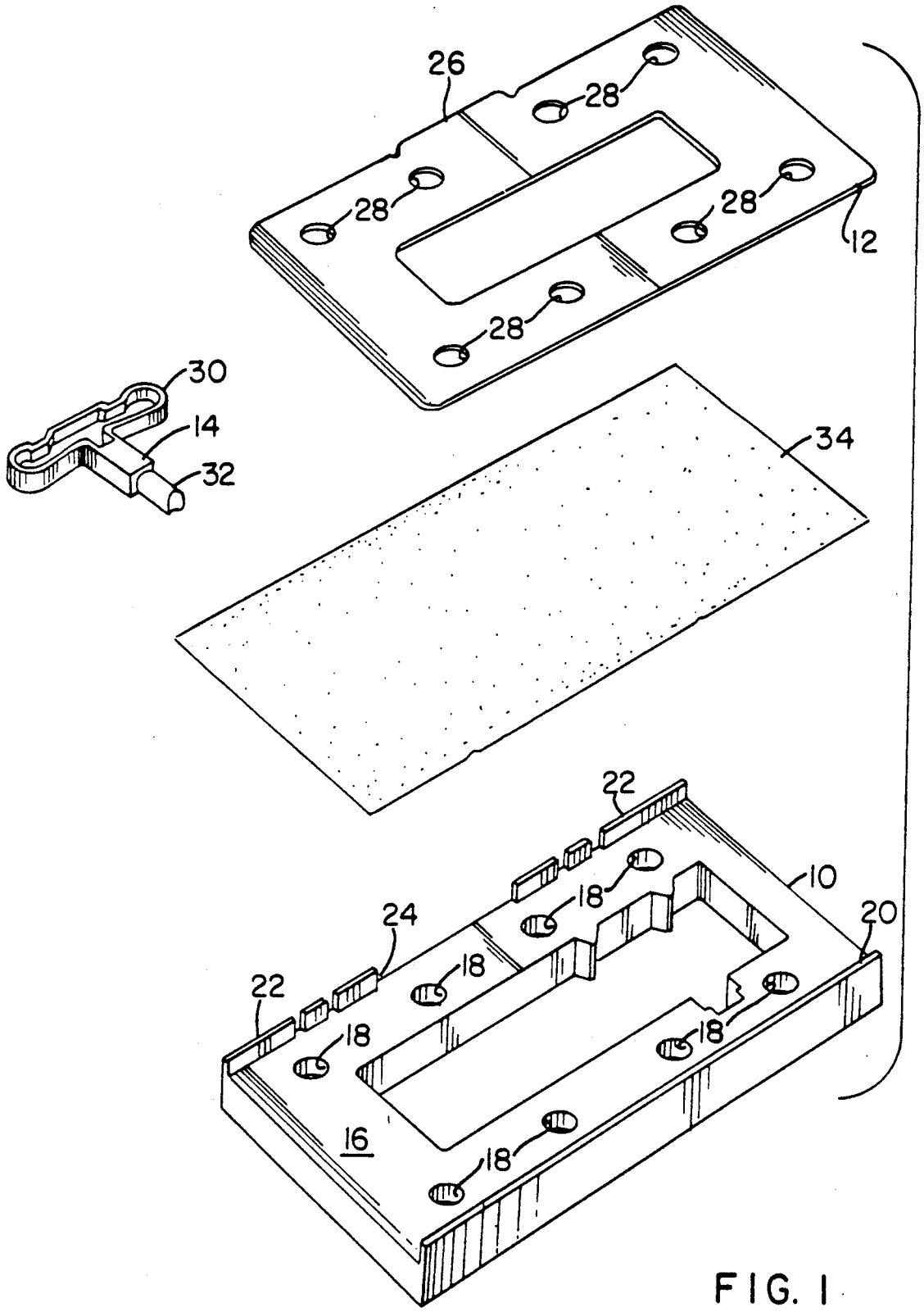
FIG. 1 PRIOR ART
FIG. 1 is an exploded perspective view of a prior art sandpaper perforating assembly.

Referring now to the drawings, FIG. 1 illustrates a prior art sandpaper perforating assembly over which the present invention is an improvement. The prior art assembly shown in FIG. 1 includes a base member 10, a plate member 12 and a punch member 14. The base member 10 has a substantially rectangular planar surface portion 16 having substantially the same dimensions as does the platen of the sander to which the assembly corresponds. The base member 10 is formed with a plurality of perforations 18 through the surface portion 16 and spaced the same as the spaced suction holes in the sander platen. The base member 10 is further formed with a straight wall 20 along an edge of the surface portion 16 and extending substantially perpendicular thereto. A second wall 22 extends along the edge of the surface portion 16 opposite the edge from which the wall 20 extends and is also substantially perpendicular to the surface portion 16. The wall 22 is preferably cut out in a region 24, for a reason which will become apparent from the following discussion.

The plate member 12 is substantially rectangular and sized so as to fit on the surface portion 16 of the base member 10 between the walls 20 and 22. One edge of the plate member 12 has a tab 26 which extends outwardly from that edge and is adapted to fit in the cut out region 24 of the wall 22 so as to properly locate the plate member 12 on the surface portion 16 of the base member 10. The plate member 12 is formed with a plurality of perforations 28 which are so situated on the plate member 28 that when it is properly located on the base member 10, the perforations 28 are in registry with the perforations 18 of the base member 10.

The punch member 14 includes a handle portion 30 and a punch tip 32. The punch tip 32 is sized so that it freely passes through the perforations 28 and 18, but with minimum clearance.

Conventional pad sanders are sized to accept either a third of a sheet of standard size sandpaper or a half sheet of standard size sandpaper. A standard size sheet of sandpaper is 9 inches by 11 inches. Thus, a third of a sheet of sandpaper is 9 inches by 3.67 inches and a half sheet of sandpaper is 9 inches by 5.5 inches. For purposes of illustration, it will be assumed that the sander for which the aforedescribed assembly is designed takes a third of a sheet of sandpaper. Therefore, its platen measures approximately 7.25 inches by 3.67 inches, with the excess sandpaper being wrapped around the ends of the platen to secure the sandpaper. To use the assembly shown in FIG. 1, the operator must first take a standard size sheet of sandpaper and cut it into one third size sheets 34 of approximate dimension 9 inches by 3.67 inches. This sheet 34 is then placed on the surface portion 16 of the base member 10 between the walls 20 and 22. Since the sheet 34 has a length of 9 inches and the length of the base member 10 corresponds to the length of the sander platen, and so is 7.25 inches, the operator must carefully place the sheet 34 centrally on the surface portion 16 so that equal length of the sheet 34 extend outwardly beyond the ends of the surface portion 16. The plate member 12 is then placed over the sheet 34 with the tab 26 located within the cut out region 24. The punch member 14 is then manipulated so that the punch tip 32 extends through the aligned perforations 28 and 18 to perforate the sandpaper sheet 34. The sheet 34 may then be creased over the edges of the base member 10 and the plate member 12 removed so as to free the sheet 34, which may then be installed on the sander platen.

The aforedescribed assembly suffers from the disadvantages that the operator must first accurately cut a sheet of sandpaper into thirds and then must accurately locate the resultant sheet on the base member 10 so that there is sufficient excess of the sheet 34 on both ends of the sander platen so that it may be wrapped around and secured to the platen, as is conventional.

Figure 2:
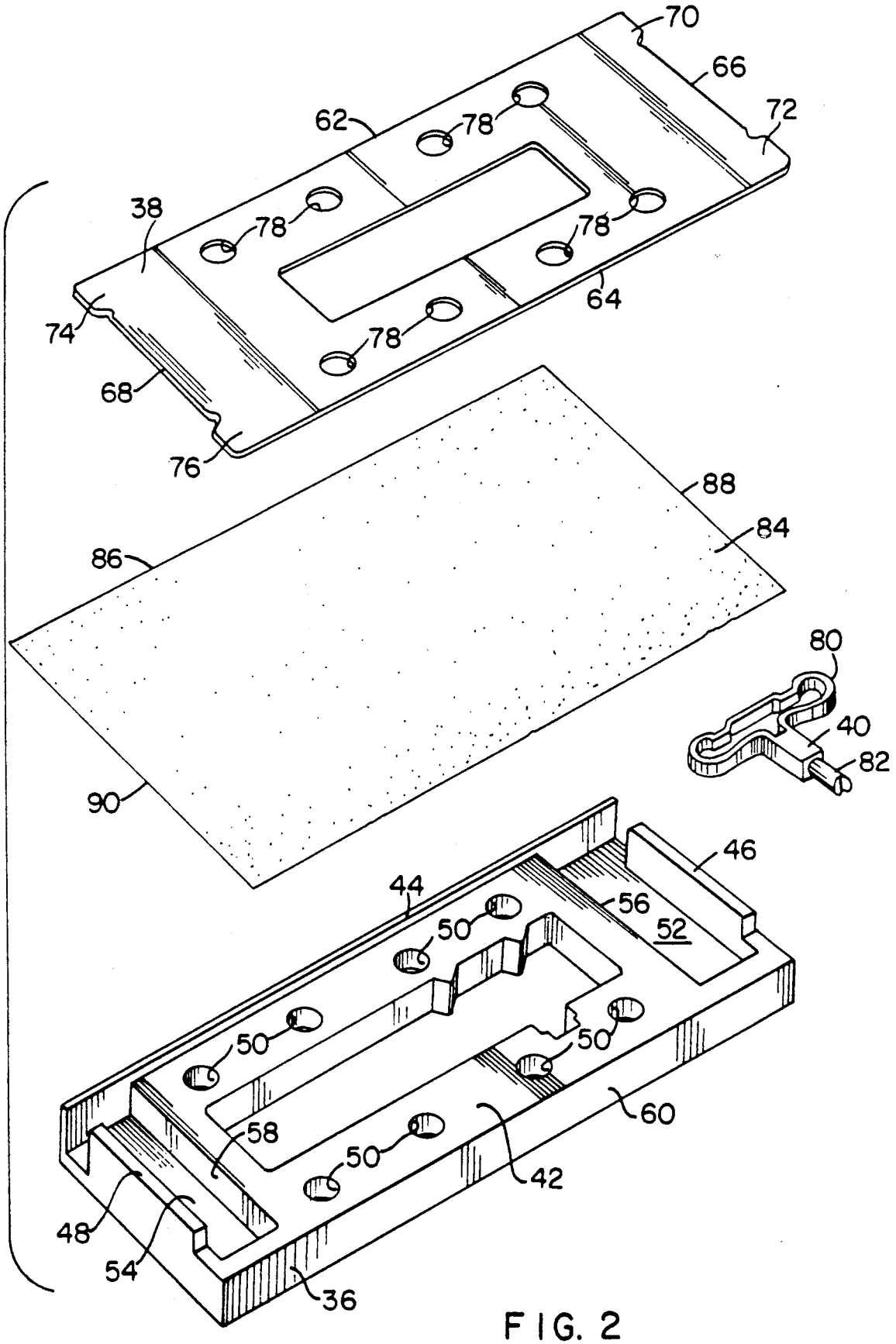
FIG. 2 is an exploded perspective view of a sandpaper sizing, perforating and precreasing assembly constructed according to this invention.
Figure 3:
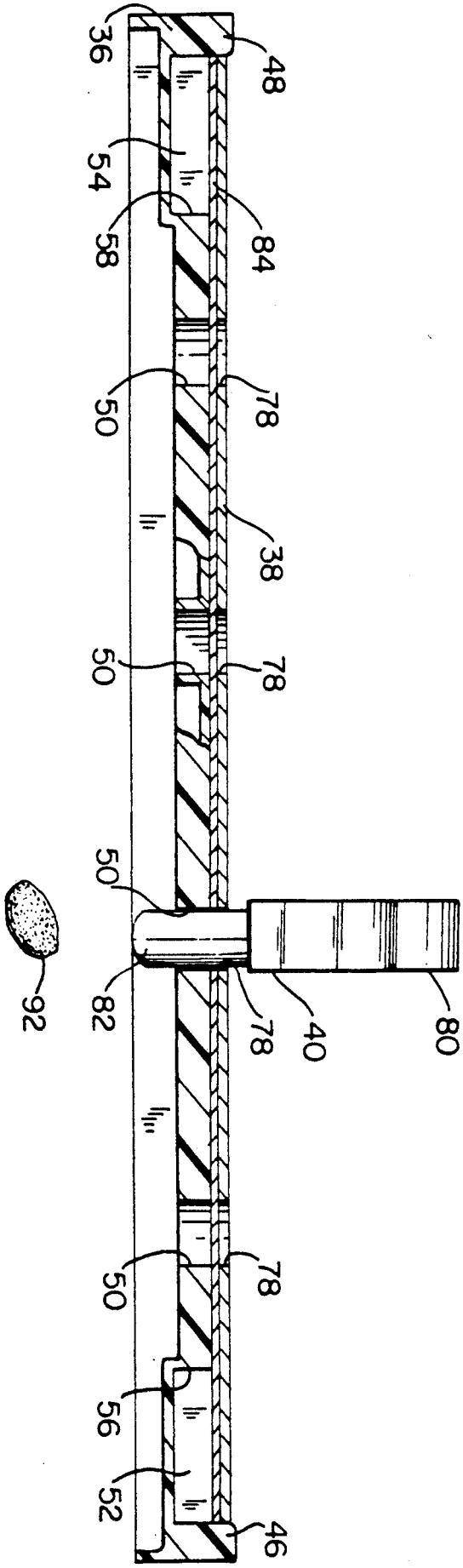
FIG. 3 is a longitudinal cross sectional view through the assembly of FIG. 2 showing the perforation operation.

The assembly shown in FIGS. 2 and 3 improves upon the assembly illustrated in FIG. 1 and has neither of the disadvantages described above. As shown in FIG. 2, the improved assembly includes a base member 36, a plate member 38 and a punch member 40. The base member 36 has a substantially rectangular planar surface portion 42 and a first straight wall 44 extending along an edge of the surface portion 42 and projecting substantially perpendicular thereto. The base member 36 also has a pair of second straight walls 46, 48 which are perpendicular to the first wall 44 and which project substantially perpendicular to the surface portion 42 in the same direction as the first wall 44. The distance between the walls 46 and 48 is substantially equal to the width of a standard size sheet of sandpaper (i.e., 9 inches) so that such a sheet can be overlaid on the surface portion 42 and accurately located thereon with an edge of the sheet abutting the first wall 44. The base member 36 is also formed with a plurality of perforations 50 through the surface portion 42. The perforations 50 are spaced the same as the suction holes in the sander platen. The base member 36 is also formed with a pair of recesses 52, 54. Each of the recesses 52, 54 extends from a respective one of the walls 46, 48 the same distance to a respective straight wall portion 56, 58 parallel to the second walls 46, 48. The distance between the straight wall portions 56, 58 is the same as the length of the sander platen and the distance from the wall 44 to the opposite side 60 of the base member 36 is equal to the width of the sander platen. The second walls 46, 48 are spaced from the first wall 44 and extend away from the first wall 44 for a distance less than the width of the sander platen. The reason for this will become apparent from the following discussion.

The plate member 38 is substantially rectangular and its width from a first edge 62 to the opposite second edge 64 is equal to the width of the sander platen. The parallel edges 66 and 68 which are perpendicular to the edges 62, 64 are spaced apart the same distance as are the second walls 46, 48 of the base member 36. The plate member 38 is formed with a pair of spaced tabs 70, 72 extending beyond the edge 66 and a pair of spaced tabs 74, 76 extending beyond the edge 68. The space between the pair of tabs 70, 72 is equal to the length of the second wall 46 of the base member 36 and the space between the tabs 74, 76 is equal to the length of the second wall 48 of the base member 36. Accordingly, when the plate member 38 is properly positioned on the surface portion 42 of the base member 36, the pair of tabs 70, 72 flank the wall 46 and the pair of tabs 74, 76 flank the wall 48. The plate member 38 is further formed with a plurality of perforations 78 which are in registry with the perforations 50 of the base member 36 when the plate member 38 is properly positioned on the surface portion 42.

The last part of the inventive assembly shown in FIG. 2 is the punch member 40 which includes a handle portion 80 and a punch tip 82. The punch tip 82 is sized to pass through the perforations 78 and 50 with minimum clearance.

When utilizing the assembly shown in FIG. 2, a sheet of sandpaper 84, which may be equal to or smaller than a 9 inch by 11 inch sheet of sandpaper is placed on the surface portion 42 of the base member 36 so that its 9 inch long edge 86 abuts the wall 44 and the two adjacent edges 88, 90 abut the walls 46 and 48, respectively. For use with the disclosed assembly, the sandpaper sheet 84 should be nine inches wide and at least as long as the width of the sander platen. The plate member 38 is then placed over the sheet 84 so that the tabs 70 and 72 flank the wall 46 and the tabs 74 and 76 flank the wall 48. The plate member 38 is then held with firm pressure against the base member 36 and the sheet 84 is torn upwardly against the edge 64 of the plate member 38. Since the recesses 52, 54 do not extend all the way to the side 60 of the base member 36, appropriate support is given to the plate member 36 all along the length of the tearing edge 64. Further, since the tabs 72 and 76 extend beyond the walls 46 and 48, respectively, the tearing edge 64 of the plate member 38 is longer than the nine inch width of the sheet of sandpaper 84. Thus, after the tearing operation, there remains sandwiched between the plate member and the base member 36 a sheet of sandpaper cut to the proper size for later installation on the sander platen.

Next, the handle portion 80 of the punch member 40 is grasped by the operator and the punch member 40 is repetitively manipulated so that the punch tip 82 extends through respective pairs of the aligned perforations 78, 50 to punch out from the sandpaper sheet 84 waste pieces 92 (FIG. 3), leaving perforations in the sandpaper sheet 84 which are properly sized and located to match the suction holes in the sander platen. The plate member 38 is then removed and the sheet 84 is creased over the wall portions 56 and 58. These creases allow the now perforated and properly sized sheet of sandpaper to be accurately located on the sander platen with properly sized free ends which can be wrapped around the ends of the sander platen for attachment thereto in a conventional manner.

Accordingly, there has been disclosed an improved assembly and method for providing from a standard size sheet of sandpaper an appropriately sized and perforated piece of sandpaper suitable for use with a pad sander having spaced suction holes in its platen. While a preferred embodiment has been disclosed, it will be apparent to those skilled in the art that various modifications to the disclosed embodiment may be made and it is only intended that the scope of this invention be limited by the appended claims.

I claim:

1. An assembly for cutting to size, and perforating air suction holes in, a sheet of abrasive material for use with a powered pad sander having spaced suction holes in its platen, comprising:

a base member including a substantially rectangular planar surface portion, a first straight wall extending along an edge of said surface portion and projecting substantially perpendicular thereto, and a pair of second straight walls perpendicular to said first wall and projecting substantially perpendicular to said surface portion in the same direction as said first wall, the distance between said pair of second walls being substantially equal to the width of a standard size sheet of sandpaper so that said first wall and said pair of second walls can accurately locate a standard size sheet of sandpaper on said surface portion with an edge of said sheet abutting said first wall, said base member being formed with a plurality of perforations through said surface portion and spaced the same as the spaced suction holes in the sander platen, said base member being formed with a pair of recesses from said surface portion, each of said recesses extending from a respective one of said second walls of said base member the same distance to a respective recessed straight wall portion parallel to said pair of second walls, said recessed straight wall portions being spaced from each other a distance corresponding to the length of the sander platen;

a substantially rectangular plate member sized so that when a first edge of said plate member abuts said base member first wall with said plate member overlying said surface portion of said base member, the opposed edges of said plate member which are perpendicular to said plate member first edge abut respective ones of said pair of second walls, the distance between said plate member first edge and the edge of said plate member opposite thereto being substantially equal to the width of the sander platen, said plate member being formed with a plurality of spaced perforations therethrough which align with the spaced perforations in said base member when said plate member is positioned on said base member surface portion with said first and opposed edges of said plate member abutting said first wall and said pair of second walls, respectively; and punch means for extending through a perforation in said plate member and an aligned perforation in said base member so as to perforate a sheet of abrasive material held between said plate member and said base member;

whereby a standard size sheet of sandpaper can be located on said base member surface portion, said plate member can be overlaid on said sandpaper, the sandpaper can be torn against said plate member opposite edge so that it is sized for installation on the sander platen, the sandpaper can be perforated in locations corresponding to the spaced suction holes in the sander platen, and the sandpaper can be creased against said recessed straight wall portions after being perforated so that it can thereafter be installed on the sander platen with the perforations in the sandpaper aligned with the suction holes in the sander platen.

2. An assembly for cutting to size, and perforating air suction holes in, a sheet of abrasive material for use with a powered pad sander having spaced suction holes in its platen, comprising:

a base member including a substantially rectangular planar surface portion, a first straight wall extending along an edge of said surface portion and projecting substantially perpendicular thereto, and a pair of second straight walls perpendicular to said first wall and projecting substantially perpendicular to said surface portion in the same direction as said first wall, the distance between said pair of second walls being substantially equal to the width of a standard size sheet of sandpaper so that said first wall and said pair of second walls can accurately locate a standard size sheet of sandpaper on said surface portion with an edge of said sheet abutting said first wall, said base member being formed with a plurality of perforations through said surface portion and spaced the same as the spaced suction holes in the sander platen, said pair of second straight walls of said base member being spaced from said first straight wall of said base member and extending away from said first straight wall for a distance less than the width of the sander platen;

a substantially rectangular plate member sized so that when a first edge of said plate member abuts said base member first wall with said plate member overlying said surface portion of said base member, the opposed edges of said plate member which are perpendicular to said plate member first edge abut respective ones of said pair of second walls, the distance between said plate member first edge and the edge of said plate member opposite thereto being substantially equal to the width of the sander platen, said plate member being formed with a plurality of spaced perforations therethrough which align with the spaced perforations in said base member when said plate member is positioned on said base member surface portion with said first and opposed edges of said plate member abutting said first wall and said pair of second walls, respectively, said plate member being formed with a pair of tabs extending beyond each of said opposed edges and spaced apart the length of said second straight walls of said base member so that each pair of tabs flanks a respective one of said base member second straight walls when said plate member is properly positioned on said base member surface portion; and punch means for extending through a perforation in said plate member and an aligned perforation in said base member so as to perforate a sheet of abrasive material held between said plate member and said base member;

whereby a standard size sheet of sandpaper can be located on said base member surface portion, said plate member can be overlaid on said sandpaper, the sandpaper can be torn against said plate member opposite edge so that it is sized for installation on the sander platen, and the sandpaper can be perforated in locations corresponding to the spaced suction holes in the sander platen.

3. A method of cutting to size, and perforating air suction holes in, a sheet of abrasive material for use with a powered pad sander having spaced suction holes in its platen, comprising the steps of:

(a) providing a base member including a substantially rectangular planar surface portion, a first straight wall extending along an edge of said surface portion and projecting substantially perpendicular thereto, and a pair of second straight walls perpendicular to said first wall and projecting substantially perpendicular to said surface portion in the same direction as said first wall, the distance between said pair of second walls being substantially equal to the width of a standard size sheet of sandpaper so that said first wall and said pair of second walls can accurately locate a standard size sheet of sandpaper on said surface portion with an edge of said sheet abutting said first wall, said base member being formed with a plurality of perforations through said surface portion and spaced the same as the spaced suction holes in the sander platen, said pair of second straight walls of said base member being spaced from said first straight wall of said base member and extending away from said first straight wall for a distance less than the width of the sander platen, said base member being further formed with a pair of recesses from said surface portion, each of said recesses extending from a respective one of said second walls of said base member the same distance to a respective recessed straight wall portion parallel to said pair of second walls, said recessed straight wall portions being spaced from each other a distance corresponding to the length of the sander platen;

(b) providing a substantially rectangular plate member sized so that when a first edge of said plate member abuts said base member first wall with said plate member overlying said surface portion of said base member, the opposed edges of said plate member which are perpendicular to said plate member first edge abut respective ones of said pair of second walls, the distance between said plate member first edge and the edge of said plate member opposite thereto being substantially equal to the width of the sander platen, said plate member being formed with a plurality of spaced perforations therethrough which align with the spaced perforations in said base member when said plate member is positioned on said base member surface portion with said first and opposed edges of said plate member abutting said first wall and said pair of second walls, respectively, said plate member being formed with a pair of tabs extending beyond each of said opposed edges and spaced apart the length of said second straight walls of said base member;

(c) providing a punch member having a punch tip sized to fit within a perforation in said plate member and an aligned perforation in said base member;

(d) placing said sheet of abrasive material on said base member surface portion so that three of its edges abut said first wall and said pair of second walls;

(e) placing said plate member over said sheet of abrasive material so that said tabs flank said pair of second walls;

(f) holding said plate member against said base member and tearing said sheet of abrasive material against said plate member opposite edge;

(g) repetitively manipulating said punch member so that said punch tip extends through the sets of aligned perforations of said plate member and said base member so as to perforate said sheet of abrasive material;

(h) removing said plate member from its overlying position on said sheet of abrasive material; and (i) creasing said sheet of abrasive material over said recessed straight wall portions of said base member.

* * * * *